US005286227A

United States Patent [19]

Numajiri et al.

[11] Patent Number: 5,286,227

[45] Date of Patent: Feb. 15, 1994

[54] ARC TUBE AND METHOD FOR MANUFACTURING THE SAME

[75] Inventors: Yasuyoshi Numajiri; Shinichi Irisawa; Kunio Fukai; Masakazu Nagasawa, all of Shizuoka, Japan

[73] Assignee: Koito Manufacturing Co., Ltd., Tokyo, Japan

[21] Appl. No.: 992,483

[22] Filed: Dec. 17, 1992

[30] Foreign Application Priority Data

Dec. 25, 1991 [JP] Japan ..... 3-342867

[51] Int. Cl.[5] ..... H01J 9/38

[52] U.S. Cl. ..... 445/26; 445/40

[58] Field of Search ..... 445/26, 39, 40, 41, 445/43

[56] References Cited

U.S. PATENT DOCUMENTS

| | | | |
|---|---|---|---|
| 4,389,201 | 6/1983 | Hansler et al. | 445/26 |
| 4,509,928 | 4/1985 | Morris et al. | 445/39 X |
| 5,108,333 | 4/1992 | Heider et al. | 445/26 |
| 5,133,682 | 7/1992 | Gilligan et al. | 445/26 |

*Primary Examiner*—Kenneth J. Ramsey
*Attorney, Agent, or Firm*—Sughrue, Mion, Zinn, Macpeak & Seas

[57] ABSTRACT

An arc tube having a closed glass bulb having no broken-off portion, and a method of manufacturing the arc tube. A glass bulb is formed on a glass tube substantially at the middle. An electrode assembly is inserted into one end portion of the glass tube, and the one end portion is closed by pinch-sealing. A light emitting material is supplied into the glass bulb through the other end portion of the glass tube, another electrode assembly is inserted into the other end portion, and the latter is closed by pinch-sealing. Since the closed glass bulb has no broken-off portion, the arc tube is free from the difficulty that the distribution of light is adversely affected. Moreover, in manufacturing the arc tube of the invention, it is unnecessary to connect an exhaust tube to the glass tube. Therefore, the number of manufacturing steps is small, and the arc tube can be manufactured with ease.

6 Claims, 6 Drawing Sheets

FIG. 7
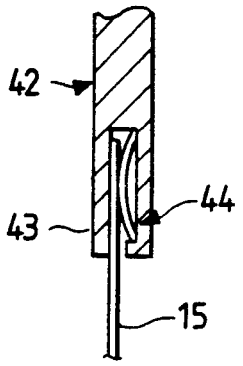
FIG. 9
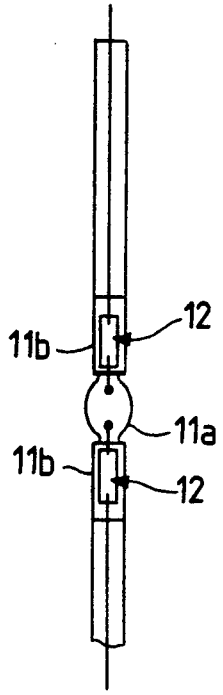
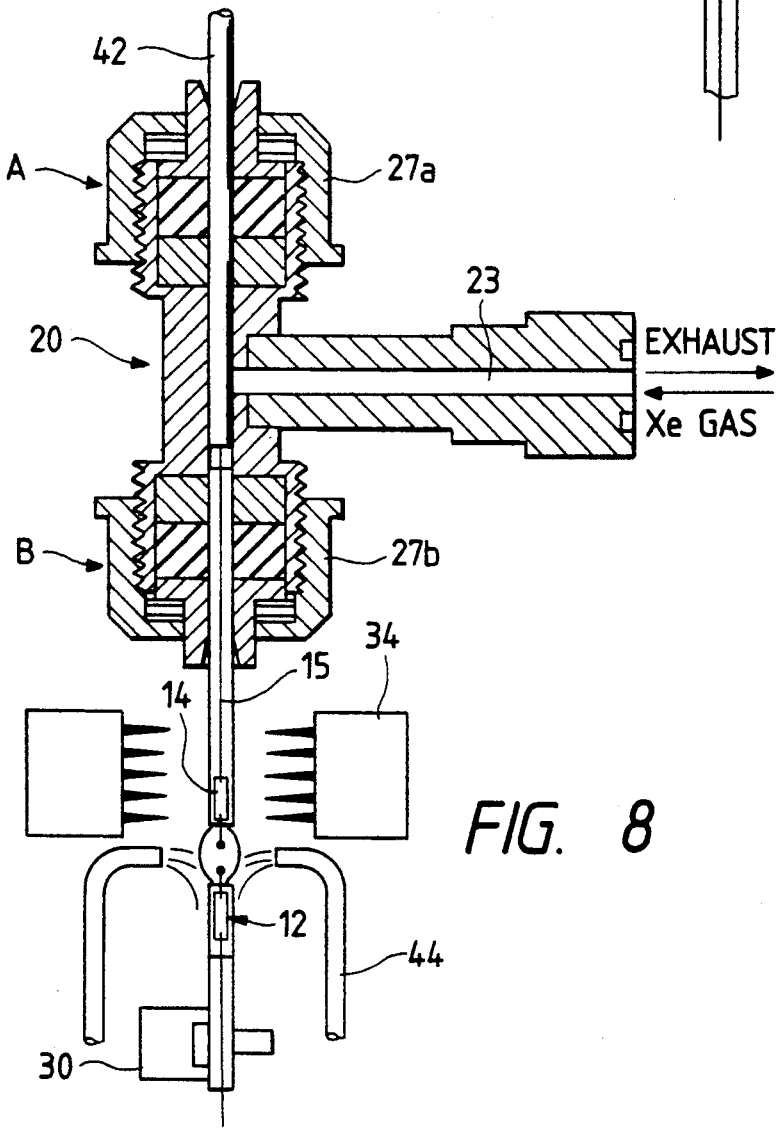
FIG. 8

ARC TUBE AND METHOD FOR MANUFACTURING THE SAME

BACKGROUND OF THE INVENTION

The present invention relates to an arc tube employed as a light source body in a discharge bulb. Recently, discharge bulbs have been extensively employed as light sources for a headlamp of a motor vehicle.

A discharge bulb is constructed generally as shown in FIG. 10. An arc tube 4 is supported by a pair of metal lead supports 2 and 3, which are embedded in an insulating base 1. To form the arc tube 4, a quartz glass tube is pinch-sealed at both ends, thus providing two pinch-sealed portions 4*b*, and a discharge section, namely, a closed glass bulb 4*a* between the pinch-sealed portions 4*b*. A pair of electrode assemblies 5 and 5, each of which is formed by a tungsten electrode bar 5*a*, a molybdenum foil 5*b* and a molybdenum lead wire 5*c*, are sealingly held in respective ones of the pinch-sealed portions 4*b* in such a manner that the electrode bars 5*a* protrude from the pinch-sealed portions into the closed glass bulb 4*a*, thus forming the aforementioned discharge section, and the lead wires 5*c* protrude outside from the pinch-sealed portions 4*b* and are welded to the lead supports 2 and 3, respectively.

To form the arc tube, a pair of electrode assemblies 5 as shown in FIG. 11 are prepared. Each of the electrode assemblies 5 is formed by connecting an electrode bar 5*a* and a molybdenum foil 5*b* as a single unit. Next, as shown in FIG. 12(*a*), while a forming gas is supplied into a quartz glass tube, a glass bulb 4*a* is formed with a metal mold. Thereafter, as shown in FIG. 12(*b*), an exhaust tube 6 is connected to the glass bulb 4*a*, the two electrode assemblies 5 are inserted into the quartz glass tube from both ends, and both end portions of the quartz glass tube where the electrode assemblies are set are heated and then pinch-sealed as shown in FIG. 12(*c*). Under this condition, as shown in FIG. 12(*d*), mercury and a metal iodide or the like is supplied into the glass bulb 4*a* through the exhaust tube 6. Thereafter, while xenon gas is supplied into the glass tube 4*a* through the exhaust tube 6, the exhaust tube 6 is broken off, as shown in FIG. 12(*e*). Subsequently, as shown in FIG. 12(*f*), the glass bulb 4*a* is cooled so that the xenon gas is held a liquid state, and the exhaust tube 6 is cut off again, this time closer to the bulb 4*a*, with a carbon dioxide laser.

In the above-described manufacture of the arc tube, the exhaust tube 6 is connected to the glass tube to form the T-shaped glass tube, and after the light emitting material is supplied to the glass tube through the exhaust tube 6, the latter 6 is broken off. Therefore, the closed glass bulb 4*a* includes a broken-off portion 4*a* (FIG. 10) which is formed when the exhaust tube 6 is broken off.

In order to ignite the arc tube quickly, it is necessary to orient it in such a manner that the broken-off portion $4a_1$ is at the top. This will be described in more detail.

In order to accelerate the gasification of the light emitting material (mercury or metal iodide), it is essential that the temperature of the entire closed glass bulb 4*a* be increased rapidly. On the other hand, of the closed glass bulb, the broken-off portion $4a_1$ is generally lowest in temperature since it is has a sharp protrusion. Therefore, the arc tube should be so oriented in such a manner that the broken-off portion $4a_1$ is the uppermost part of the closed glass bulb, which part is readily increased in temperature.

On the other hand, with respect to the distribution of light, light emitted from the upper portion of the glass bulb 4*a* is most effective. However, the broken-off portion $4a_1$ when at the top can scatter light, producing glare.

In addition, gravity acts on the arc formed between the electrodes, curving it downward. The total amount of curvature of the arc is proportional to the distance between the arc and the inner surface of the glass bulb. Therefore, the broken-off portion $4a_1$ increases the curvature of arc. In addition, the curvature of the arc depends on the position of the broken-off portion $4a_1$. Accordingly, in assembling the discharge bulb, it is essential that the glass bulb be positioned so that the broken-off portion $4a_1$ is the uppermost part thereof. This requirement is a factor which, in assembling the discharge bulb, lowers the work efficiency.

SUMMARY OF THE INVENTION

In view of the foregoing, an object of the invention is to provide an arc tube having a closed glass bulb having no broken-off portion. Another object of the invention is the provision of a method for manufacturing such an arc tube.

In order to achieve the foregoing and other objects of the invention, there is provided an arc tube formed by inserting electrode assemblies into a glass tube from both ends and closing both end portions of the glass tube by pinch-sealing to hold the electrode assemblies therein and to form a closed glass bulb at the middle of the glass tube in which a light emitting material is sealingly held, in which, in accordance with the invention, the closed glass bulb has curved walls which are smooth, including no broken-off or protruding portion.

In addition, there is provided a method for manufacturing an arc tube in which a glass bulb is formed in a glass tube substantially at the middle thereof, an electrode assembly is inserted into one end portion of the glass tube, the one end portion is closed by pinch-sealing, a light emitting material is supplied into the glass bulb through the other end portion thereof, and another electrode assembly is inserted into the other end portion, and the latter is closed by pinch-sealing.

In the arc tube of the invention, the closed glass tube, which is a discharge section, has curved walls which are smooth, including no broken-off or protruding portions which could adversely affect the distribution of light. Therefore, in assembling the discharge bulb, it is unnecessary to accurately rotationally position the closed glass tube with respect to the axis of the arc tube.

Moreover, the method of the invention dispenses with the step of connecting the exhaust tube and the step of breaking off the exhaust tube, which are essential in the conventional method.

BRIEF DESCRIPTION OF THE DRAWINGS

FIG. 7 is a sectional view showing essential parts of an electrode assembly supplying rod;

FIG. 8 is a diagram showing a second pinch-sealing step.

FIG. 9 is a diagram showing an arc tube manufactured according to a method of the invention;

DESCRIPTION OF THE PREFERRED EMBODIMENTS

Preferred embodiments of the invention will be described with reference to the accompanying drawings.

Figure 1:
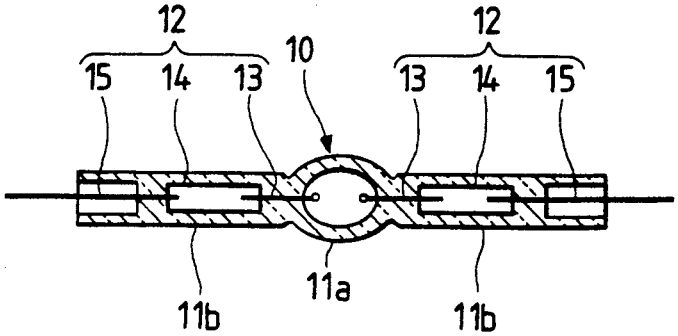
FIG. 1 is a sectional view showing an example of an arc tube constructed according to the invention.

FIG. 1 is a longitudinal sectional view of an arc tube constructed according to the invention. In FIG. 1, reference numeral 10 designates the arc tube, which is formed as follows:

A glass tube 11 is sealed at both ends by pinching, thus forming a pair of pinch-sealed portions 11*b*. A closed glass bulb 11*a* is formed between the pinch-sealed portions 11*b*, in which a light emitting material such as mercury and a metal iodide is sealed together with xenon gas. A pair of electrode assemblies 12, each of which is formed by a tungsten electrode bar 13, a molybdenum foil 14, and a molybdenum lead wire 15, are sealingly held in the respective pinch-sealed portions 11*b*. More specifically, the electrode bars 13 protrude into the glass bulb 11*a* with their ends confronting each other.

Figure 10:
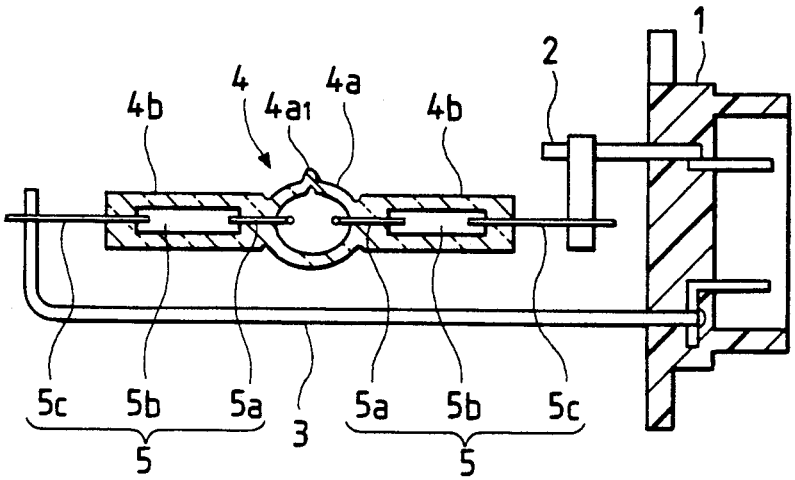
FIG. 10 PRIOR ART
FIG. 10 is a longitudinal sectional view of a discharge bulb device.
Figure 11:
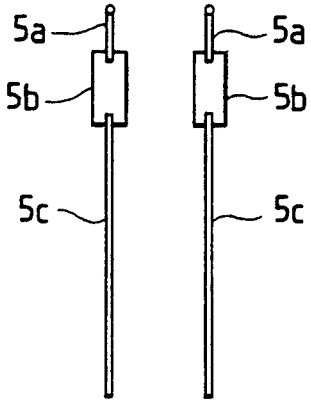
FIG. 11 PRIOR ART
FIG. 11 is a front view of a pair of electrode assemblies.
Figure 12A:
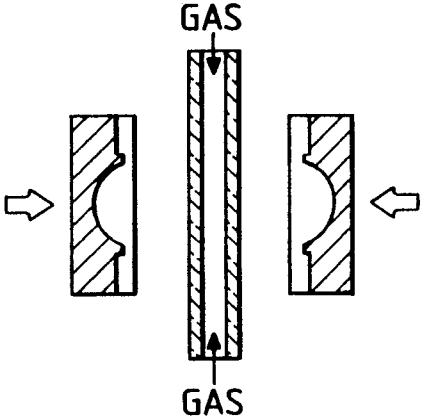
FIG. 12(a) PRIOR ART
FIGS. 12(*a*) through 12(*f*) are explanatory diagrams for a description of a conventional method of manufacturing an arc tube.
Figure 12B:
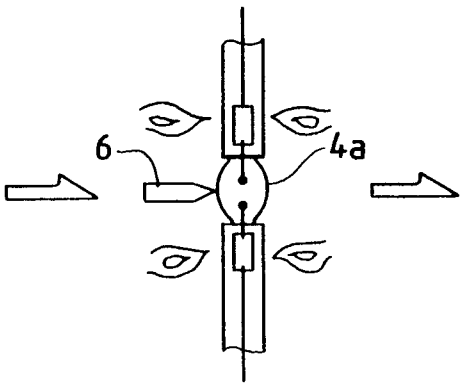
FIG. 12(b) PRIOR ART
Figure 12C:
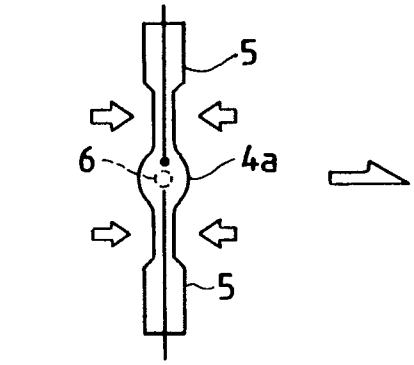
FIG. 12(c) PRIOR ART
Figure 12D:
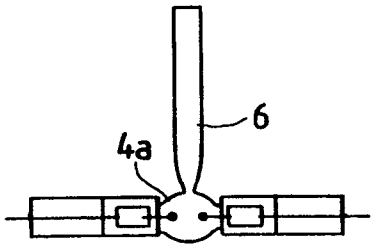
FIG. 12(d) PRIOR ART
Figure 12E:
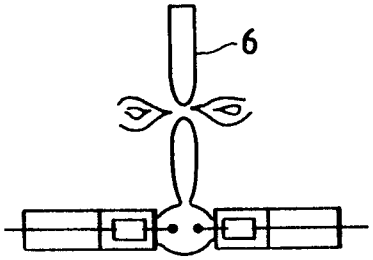
FIG. 12(e) PRIOR ART
Figure 12F:
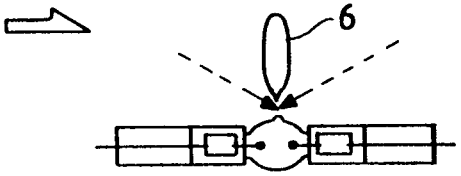
FIG. 12(f) PRIOR ART

The closed glass bulb 11*a* has no broken-off portion; that is, it is substantially in the form of an ellipsoid having smooth surfaces. Therefore, the closed glass bulb 11*a*, unlike the conventional bulb 4*a* (FIG. 10) having the broken-off portion $4a_1$, will not adversely affect the distribution of light. Furthermore, since the glass bulb 11*a* has no broken-off portion, in fixing the arc tube to the base 1 (FIG. 10), it is unnecessary to accurately position the arc tube around the axis. Hence, the work of assembling the bulb can be achieved readily and quickly.

Figure 2:
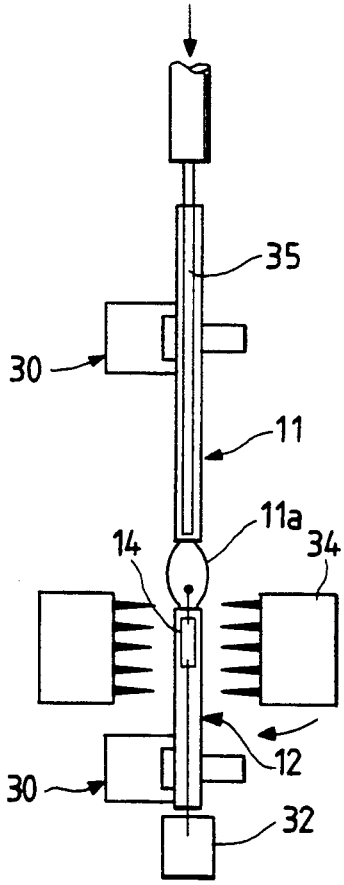
FIG. 2 is a diagram showing a first pinch-sealing step.

FIGS. 2 through 9 are diagrams for a description of the manufacture of the arc tube shown in FIG. 1. More specifically, FIG. 2 is a diagram showing a first pinch-sealing step, FIG. 3, a step of supplying metal iodide, FIG. 4, a step of baking the metal iodide, FIG. 5, a step of supplying o mercury, and FIG. 6, a step of supplying the electrode assembly. Furthermore, FIG. 7 is an enlarged sectional view showing the end portion of an electrode assembly supplying rod, FIG. 8 is a diagram showing a second pinch-sealing step, and FIG. 9 is a diagram showing an arc tube manufactured according to the method of the invention.

Figure 3:
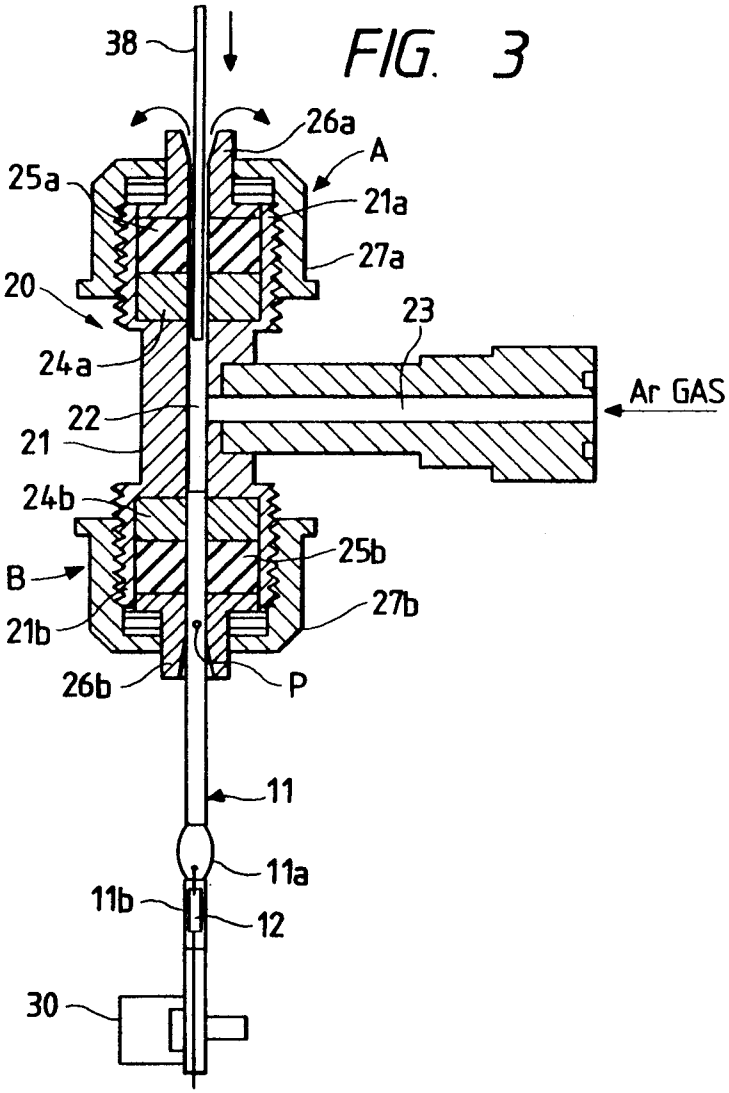
FIG. 3 is a diagram showing a step of supplying metal iodide.

In FIG. 3, reference numeral 20 designates a T-shaped arc tube connecting head having a T-shaped tubular passage consisting of a vertical tubular passage 22 extending vertically, and a horizontal tubular passage 23 extending horizontally from the middle of the vertical tubular passage 22. The vertical tubular passage 22 is provided with chuck mechanisms A and B at its upper and lower ends. The chuck mechanisms A and B include bases 24*a* and 24*b*, cylindrical rubber bushings 25*a* and 25*b*, and flanged cylinders 26*a* and 26*b*, which are all accommodated in the cylindrical portions 21*a* and 21*b* of the head body 21, and tightening nuts 27*a* and 27*b* engaged with male-threaded portions of the cylinders 21*a* and 21*b* to hold the flanged cylinders 26*a* and 26*b*, respectively.

Figure 4:
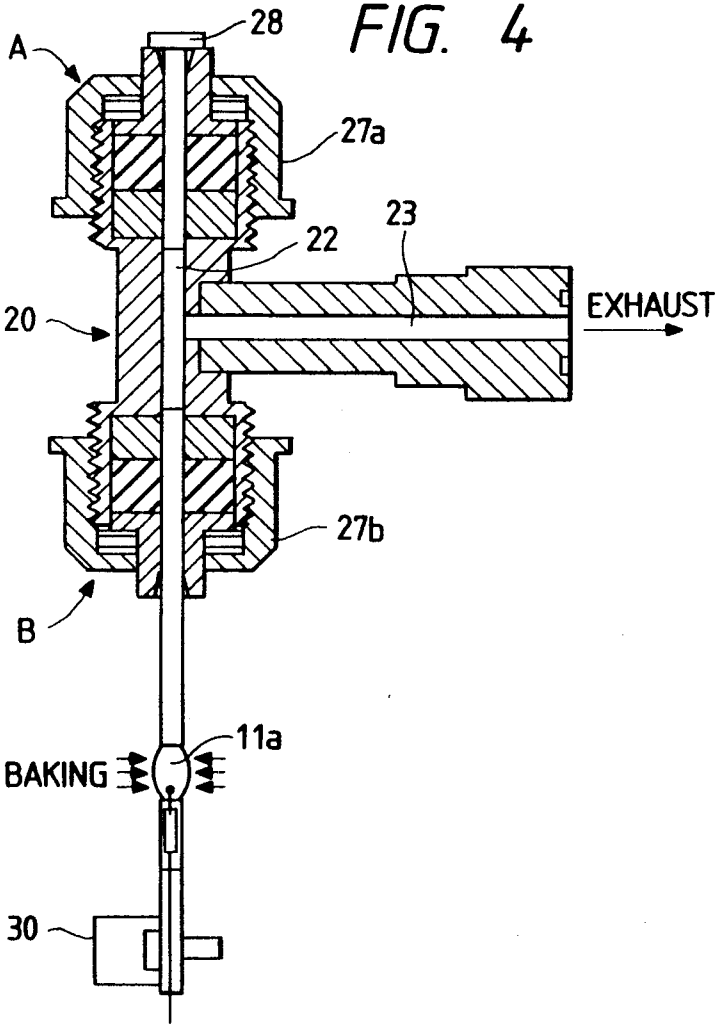
FIG. 4 is a diagram showing a step of heating the metal iodide.

After the arc tube is inserted into the bushing 25*b*, the nut 27*b* is tightened so that the bushing 25*b* is compressed axially and spread radially. As a result, the tube is held closely in the vertical path 22. In FIG. 4, reference 28 designates a blank cap engaged with the upper end opening of the vertical tubular passage 22 to close the latter.

A method of manufacturing an arc tube using the T-shaped arc tube connecting head 20 now will be described.

First, a step of forming a glass bulb is carried out. That is, the middle portion of a glass tube 11 is formed into a glass bulb. (This step is the same as that employed in the conventional method illustrated in FIG. 12(*a*).) Thereafter, as shown in FIG. 2, the glass tube 11 is held vertical with glass tube chucks 30, and the electrode assembly 12, held with an electrode holder 32, is inserted into the glass tube 11 through its lower end opening and positioned therein. Under this condition, the part of the glass tube 11 where the molybdenum foil 14 of the electrode assembly is held is heated with rotary burners 34, while the glass bulb 11*a* is pinch-sealed near one end while a forming gas is supplied through a gas supplying tube 35 inserted into the glass tube 11 from above.

Thereafter, as shown in FIG. 3, the upper end portion of the glass tube 11 is inserted into the lower tube inserting hole of the T-shaped arc tube connecting head 20, and the vertical tubular passage 22 is closed with the blank cap 28 set at the top. Under this condition, the glass bulb 11*a* is evacuated through the horizontal tubular passage 23. Thereafter, the blank cap 28 is removed, and while argon gas is supplied into the glass bulb 11*a* through the horizontal tubular passage 23, a pellet supplying nozzle 38 is inserted into the vertical tubular passage 22 to drop a pellet P of metal iodide into the glass bulb 11*a*. The pellets P are supplied to the nozzle 38 one at a time by an automatic pellet supplying device (not shown). A pellet P supplied through the nozzle 38 is allowed to drop into the glass bulb 11*a* filled with argon gas. Next, as shown in FIG. 4, the vertical tubular passage 22 of the head 20 is closed with the blank cap 28 set at the top, and the horizontal tubular passage is opened. Under this condition, a heating process is carried out; that is, the glass bulb 11*a* is heated at about 600° C. with a burner or the like to remove impurities such as water from the pellet P in the glass bulb 11*a*.

Figure 6:
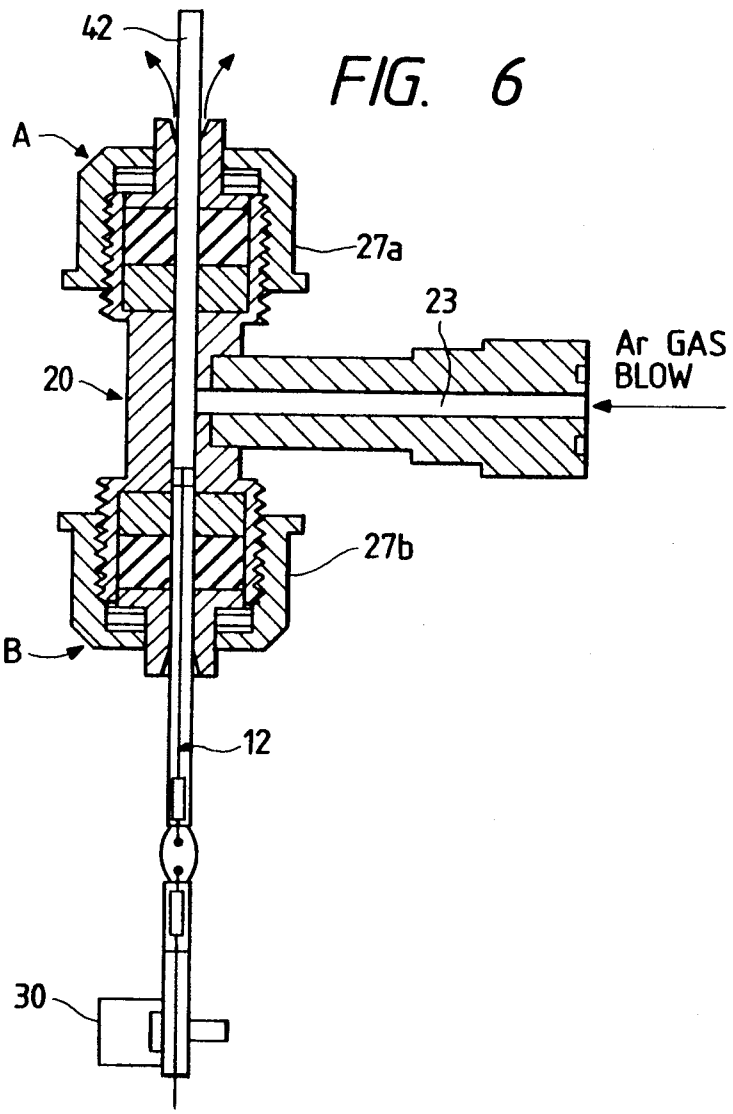
FIG. 6 is a diagram showing a step of supplying an electrode assembly.
Figure 5:
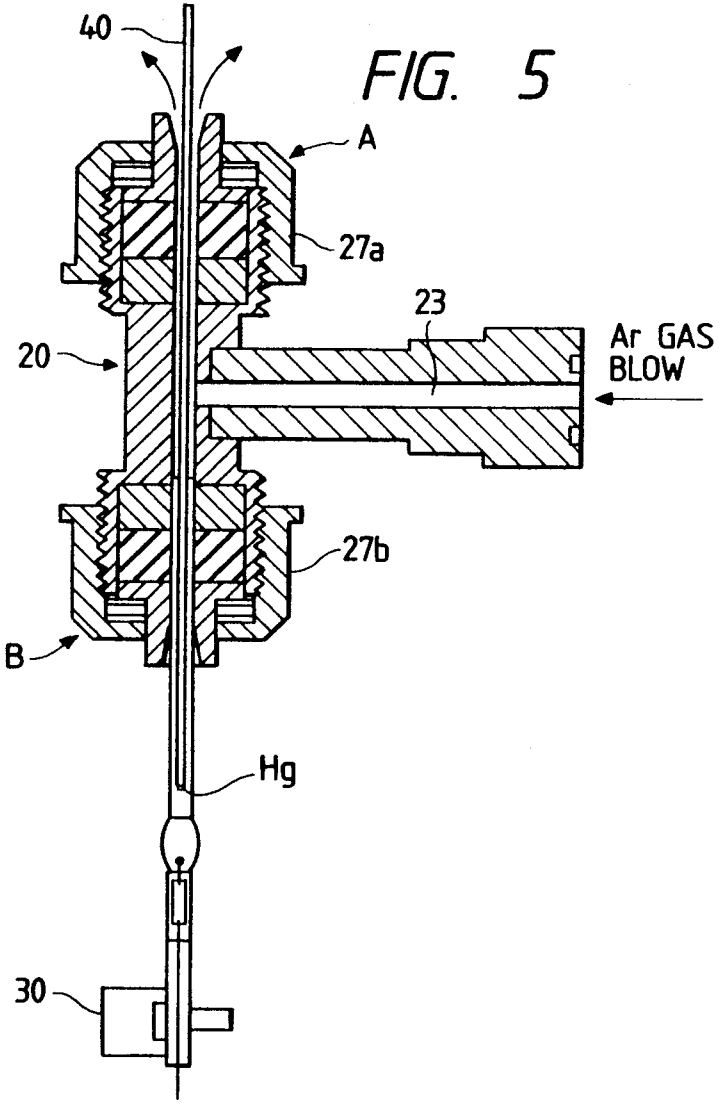
FIG. 5 is a diagram showing a step of supplying mercury.

Next, as shown in FIG. 5, while argon gas is supplied into the glass bulb 11*a* through the horizontal tubular passage 23, mercury particles are dropped into the glass bulb 11*a* through a mercury particle supplying nozzle 40. Thereafter, as shown in FIG. 6, while argon gas is supplied into the glass bulb through the horizontal tubular passage 23, another electrode assembly 12 is inserted into the glass tube from above using an electrode assembly supplying rod 42. The electrode assembly supplying rod 42, as shown in FIG. 7. has a leaf spring type clamping device at the end 43. The electrode assembly 12 is held by the clamping device 44 in such a manner that it is suspended therefrom. When it is detected with an optical device such as a television camera or optical detector that the electrodes are spaced from each other as required, the nut 27*a* is tightened to hold the electrode assembly 12 in place. Under this condition, as shown in FIG. 8, the glass tube 11 is partially evacuated through the horizontal tubular passage 23, and xenon gas is supplied thereinto, while liquid nitrogen is applied to the outside of the glass bulb 11*a* through liquid nitrogen supplying tubes 44, thereby to maintain the xenon gas in a liquid state, while the rotary burners 34 are operated to heat the part of the glass tube 11 where the molybdenum foil is held, thereby to pinch-seal it.

Thus, the arc tube has been manufactured with the light emitting material sealingly held in the glass bulb 11*a*. The two end portions of the glass tube are cut to predetermined lengths to obtain the desired arc tube.

As is apparent from the above description, in the arc tube according to the invention, the closed glass bulb serving as a discharge section is formed with curved walls which are smooth, having no broken-off or protruding portions which can adversely affect the distribution of light. Hence, in assembling the discharge bulb, it is unnecessary to position the arc tube around the axis of the glass bulb at any particular angular position. Thus, the discharge bulb can be assembled with ease.

Moreover, the method of manufacturing the arc tube according to the invention dispenses with the steps of connecting the exhaust tube and breaking off the latter, which are essential for the conventional method. Hence, not only the number of components required for manufacture of the arc tube but also the number of manufacturing steps is reduced.

What is claimed is:

1. A method for manufacturing an arc tube, comprising the steps of:

forming a glass bulb in a glass tube substantially at a middle portion of said glass tube;

inserting an electrode assembly into one end portion of said glass tube;

closing said one end portion by pinch-sealing;

supplying a light emitting material into said glass bulb through the other end portion of said glass tube by the steps of:

supplying an inert gas into said glass bulb, inserting a supply nozzle into said glass bulb, dropping at least one pellet of a light-emitting material from said pellet supplying nozzle into said glass bulb and heating said glass bulb to remove impurities from said light-emitting material;

inserting another electrode assembly into said other end portion; and closing said other end portion by pinch-sealing.

2. The method for manufacturing an arc tube of claim 1, wherein said light-emitting material comprises a metal halide.

3. The method for manufacturing an arc tube of claim 2, wherein said metal halide is a metal iodide.

4. The method for manufacturing an arc tube of claim 1, wherein said light-emitting material comprises droplets of mercury.

5. The method for manufacturing an arc tube of claim 1, wherein said step of closing said one end portion by pinch-sealing comprises the steps of:

heating said one end portion with rotary burners while supplying a forming gas into said glass bulb through said other end portion; and pinching said one end portion.

6. The method for manufacturing an arc tube of claim 1, wherein said step of closing said other end portion by pinch-sealing comprises the steps of:

partially evacuating said glass tube;

supplying xenon gas into said glass tube;

applying liquid nitrogen to the outside of said glass bulb to maintain said xenon gas in a liquid state;

heating said other end portion with rotary burners; and pinching said other end portion.

* * * * *